US006290636B1

(12) United States Patent
Hiller, Jr. et al.

(10) Patent No.: US 6,290,636 B1
(45) Date of Patent: Sep. 18, 2001

(54) HELIX CENTRIFUGE WITH REMOVABLE HEAVY PHASE DISCHARGE NOZZLES

(76) Inventors: Georg Hiller, Jr., Schwalbenholzstrabe 2, 84137 Vilsbiburg (DE); Dietmar J. Neidhardt, 129 Grogans Point Rd., The Woodlands, TX (US) 77380

( * ) Notice: Subject to any disclaimer, the term of this patent is extended or adjusted under 35 U.S.C. 154(b) by 0 days.

(21) Appl. No.: 09/561,307

(22) Filed: Apr. 28, 2000

(51) Int. Cl.[7] ..... B04B 1/20; B04B 11/00
(52) U.S. Cl. ..... 494/53; 494/56
(58) Field of Search ..... 494/50–54, 56; 210/380.1, 380.3

(56) References Cited

U.S. PATENT DOCUMENTS 3,575,709 * 4/1971 Ferney .
4,298,159 * 11/1981 Epper et al. .
4,339,072 * 7/1982 Hiller .
5,234,400 * 8/1993 Kluge ..... 494/53
5,252,209 * 10/1993 Retter ..... 210/380.3
5,342,281 * 8/1994 Unkelbach et al. ..... 494/53
5,545,119 * 8/1996 Schlip et al. ..... 494/53
5,584,791 * 12/1996 Grimwood et al. ..... 494/54
5,792,039 * 8/1998 Green et al. ..... 494/53

FOREIGN PATENT DOCUMENTS

3620912 * 12/1987 (DE) .
4112957 * 10/1992 (DE) .
670306 * 11/1929 (FR) .
372679 * 5/1932 (GB) .

* cited by examiner

*Primary Examiner*—Charles E. Cooley
(74) *Attorney, Agent, or Firm*—Browning Bushman

(57) ABSTRACT

The centrifuge continuously separates free flowing substances that have different densities. The centrifuge includes a rotor 14 having a cylindrical drum 16 and a conical drum 18. The rotor wall includes discharge ports 48, 48', 48" for a heavy phase and weirs 38 for a light phase arranged on a front end wall 36 of the cylindrical drum. The rotatable scroll conveyor 22 includes a hollow shaft 26 and a helix 24 for transporting the heavy phase toward the discharge ports. A feed pipe 28 is coaxially within the hollow shaft and opens into a chamber 32 within the hollow shaft. A plurality of nozzles each within a respective discharge port in the conical drum and a non-restrictive discharge port 60 in the end section of the conical drum discharge the heavy phase from the centrifuge. The nozzles are preferably arranged in a plurality of circumferential rings.

20 Claims, 3 Drawing Sheets

HELIX CENTRIFUGE WITH REMOVABLE HEAVY PHASE DISCHARGE NOZZLES

FIELD OF THE INVENTION

The present invention relates to a solid bowl helix centrifuge for continuous separation of free-flowing substances that have different densities, and particularly for continuously separating a solid-liquid mixture.

BACKGROUND OF THE INVENTION

DE-A 41 12 957 describes a solid bowl helix centrifuge somewhat similar to the solid bowl helix centrifuge whose principle features are indicated above. In the earlier-model, the rotor is delimited by face walls at both extremities and the decanting apertures in the wall of the cylindrical drum are very small; this has the effect of blocking the light phase that is to be decanted. The heavy phase is removed through narrow discharge apertures in the conical drum section. Since the face of the conical drum is closed, it is practically impossible to avoid clogging at this point. This in turn compromises the degree of purity of the light phase. The fact that the mixture to be separated enters the centrifuge in the front section of the cylindrical drum exacerbates this deficiency, since the heavy phase is deposited on the internal wall over the entire length of the rotor and must be transported from there by the scroll conveyor against the flow of the light phase. As a consequence, the scroll conveyor requires a relatively powerful motor.

A solid bowl helix centrifuge of the type disclosed herein is also shown and discussed in U.S. Pat. No. 5,792,039. Here too, the extremity wall of the conical drum is blind. In this case, the heavy phase that has entered the conical drum must be returned to the cylindrical drum axially of the scroll conveyor. To this end, the helices in the conical and the cylindrical drums are constructed to operate in opposing directions. The discharge ports for the heavy phase form a ring in the wall of the cylindrical drum and are arranged in such a way that they are axially offset toward the face wall of the cylindrical drum relative to the inlet apertures of the chamber in the hollow shaft. The effect of this configuration is that the heavy phase is moved in one direction within the conical drum and in the opposite direction in the cylindrical drum.

The disadvantages of the prior art are overcome by the present invention, and an improved solid bowl centrifuge is hereinafter disclosed which offers significant improvements over prior art centrifuges.

SUMMARY OF THE INVENTION

The centrifuge according to a preferred embodiment includes a rotor that consists of a cylindrical and a conical drum. The rotor wall is furnished with discharge ports for the heavy phase, and weirs for the light phase are arranged on the frontal wall of the cylindrical drum. The centrifuge includes a rotatable scroll conveyor inside the rotor for the purpose of transporting the heavy phase towards the discharge ports. A mixture feed pipe is arranged coaxially within the hollow shaft supporting the helix of the scroll conveyor, and opens into a chamber within the hollow shaft, from which chamber feed apertures lead to the helix.

The task of this invention has been to produce a helix centrifuge in which the heavy phase is conveyed from the chamber formed in the hollow shaft to the discharge ports by the shortest possible route and against the flow of the light phase without causing blockage in the conical drum.

With respect to a solid bowl helix centrifuge of such type, the present invention provides that, at least in the conical drum, the discharge ports take the form of nozzles that are followed by non-restrictive discharge ports in the end section of the conical drum for the heavy phase or a third, intermediate phase.

Functioning is further improved if the discharge ports in the form of nozzles are arranged in rings in the wall of the rotor and are on the same longitudinal section of the rotor or are axially offset relative to the end section of the conical drum.

The present invention represents a considerable advance over the prior art in that the heavy phase is transported to the discharge ports against the flow of the light phase immediately from the feed apertures, while the light phase migrates in the opposite direction towards the weirs in the face wall of the cylindrical drum, thereby avoiding the risk of renewed contamination with the heavy phase. Since the heavy phase is removed rapidly, the degree of purity of the light phase remains very high. There is an additional advantage in that the heavy phase has to travel only a short distance in the area of the chamber feed apertures. As a consequence, the spin drive of the scroll conveyor requires a low torque. Finally, the non-restrictive discharge ports are in the end section of the conical drum, so that a blockage cannot occur at this point, as would happen if larger particles of the heavy phase were unable to pass through the narrow discharge ports of the nozzles. If the distance radial to the rotor axis is small enough between the non-restrictive discharge ports and the nozzle discharge ports, the helix centrifuge may operate in three phase mode, in which an intermediate phase is discharged through the non-restrictive discharge ports.

The nozzle-shaped discharge ports in ring arrangements may be arranged on any longitudinal section of the rotor, and preferably on the conical drum, depending on the intended density and consistency of the heavy phase.

In an improved version of the invention, it may be advantageous if the conical drum is furnished with multiple discharge ports, arranged in rings at fixed axial intervals. It is then beneficial if the discharge ports of the nozzles that are located closer axially to the end section of the conical drum have a reduced aperture profile. In this way, it is possible to use the nozzles to separate different particle sizes in the heavy phase.

According to a further feature of the invention, provision has been made so that the nozzles are removable and screwed into threaded holes in the rotor wall. When the nozzles are not in place, these threaded holes may be plugged with screw bolts. This in turn allows he possibility of configuring a standard centrifuge in which, depending on the desired density and consistency of the heavy phase, the redundant discharge ports are closed off.

These and further objects, features and advantages of the present invention will become apparent from the following detail description, wherein reference is made to the figure in the accompanying drawing.

DETAILED DESCRIPTION OF PREFERRED EMBODIMENTS

Figure 1:
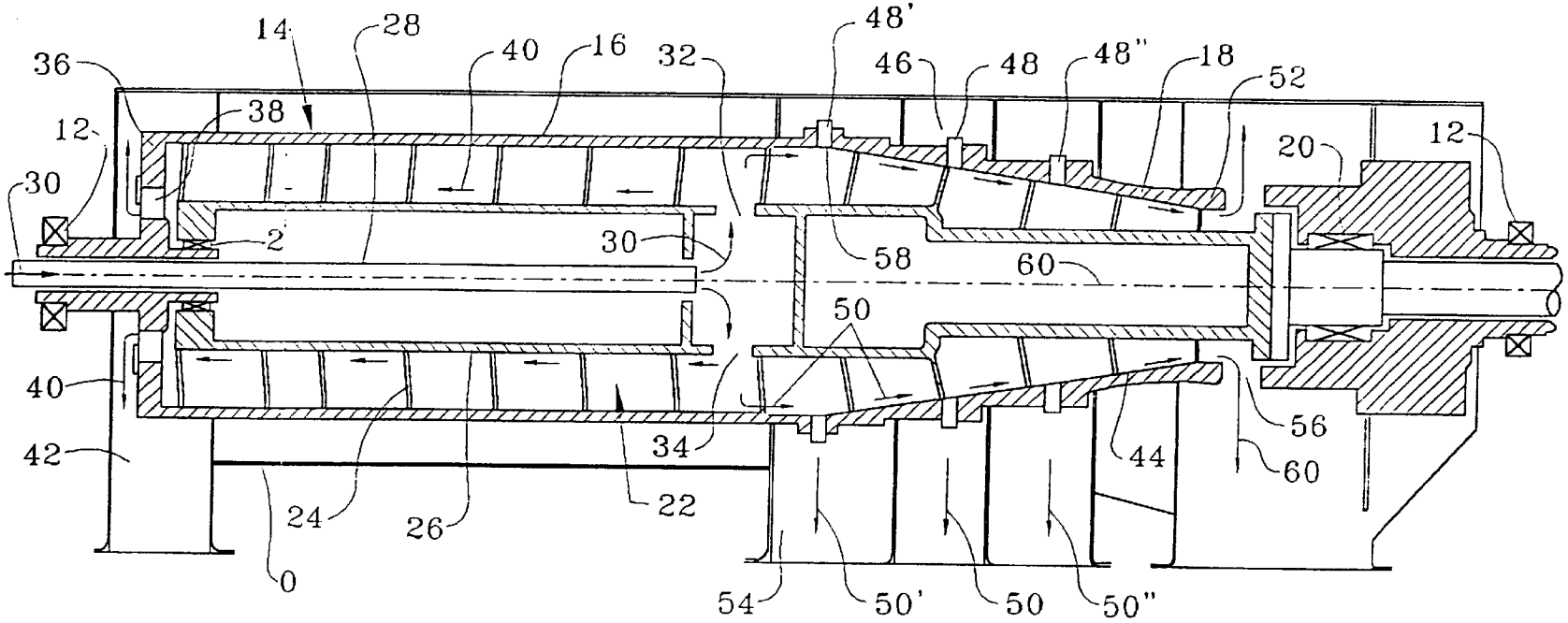
FIG. 1 shows a schematic longitudinal section through a solid bowl helix centrifuge in accordance with the present invention.

In housing 10, rotatable rotor 14 is supported on bearings 12. The rotor drive is not shown. Rotor 14 includes a cylindrical drum 16 and an attached conical drum 18 each rotatable about axis 60. Both drums are of substantially equal in axial length.

The rotatable scroll conveyor 22, the drive of which is also not shown, is supported on central bearings 20 in rotor 14, and normally rotates at a slightly higher speed but in the same direction as rotor 14. Helix 24 of scroll conveyor 22 is attached to hollow shaft 26 and is arranged in such a way that the decanted material flows from cylindrical drum 16 to conical drum 18.

A feeder pipe 28 for inputting the mixture to be separated is positioned within hollow shaft 26. Feeder pipe 28 discharges into chamber 32 that is located axially in a middle section of hollow shaft 26. Feed apertures 34 lead from this chamber 32 to the area of helix 24.

Cylindrical drum 16 has an end wall 36. The wall 36 is furnished with weirs 38 for the purpose of decanting the light phase 40. These weirs are height-adjustable and shaped in a manner known in the art. The light phase migrates into decanting pipe 42 for discharging from the housing 10.

Rotor wall 44 of conical drum 18 is furnished with discharge ports 46 for heavy phase 50. These discharge ports 46 are arranged in rings and are axially spaced and are between the end section 52 of conical drum 18 and the feed apertures 34 from chamber 32. This has the effect that the heavy phase 50 moves towards discharge ports 46 behind the feed apertures 34 by the shortest route in the direction of flow as indicated by arrows 50. At the same time, light phase 40 migrates in the opposite direction through cylindrical drum 16 towards weirs 38. Since there is no heavy phase 50 in this section, the level of purity of the separated light phase 40 is very high.

The axial position of discharge ports 46 in the rotor 14 is selected according to the desired density and consistency of heavy phase 50. Preferably the discharge ports are in the conical drum 18, but some ports could be selectively positioned in the cylindrical drum 16. In the configuration of the example, two further possible positions are shown upstream and downstream of discharge ports 46 with nozzles 48. Nozzles 48 also may be arranged in circumferential rings in the positions indicated by 48' and 48". As is shown in the drawing, it is also possible to provide for more than one ring of nozzles 48. The drawing shows three such rings. In such a case, it is necessary, to ensure the opposite flow direction of heavy phase 50 and light phase 40, that the ring arrangement of nozzles 48' that is located the farthest from end section 52 of conical drum 18 and toward the apertures 34. In an extreme case, the nozzles 48 could be in the cylindrical drum 16.

Figure 2:
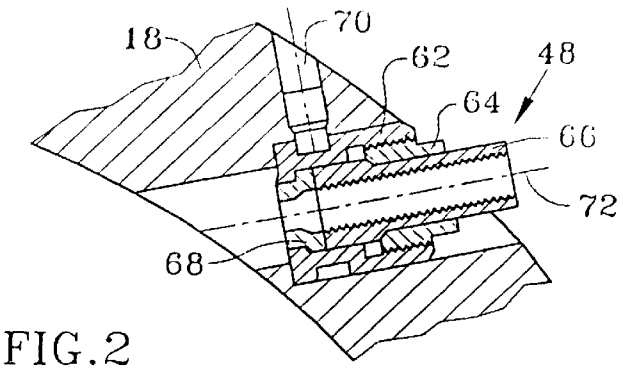
FIG. 2 a cross sectional view of a nozzle as shown in FIG. 1.

FIG. 2 illustrates in further detail a suitable nozzle 48 according to the present invention within the side wall of the conical drum 18. The nozzle 48 includes a carrier 62, a nut 64, a pipe insert 66, and a nozzle insert 68. The carrier 62 may be held in place by set screw 70. As shown in FIG. 2, the axis 72 of the insert is angled with respect to the wall 18 allowing the discharge to trail the movement of the drum.

Figure 3:
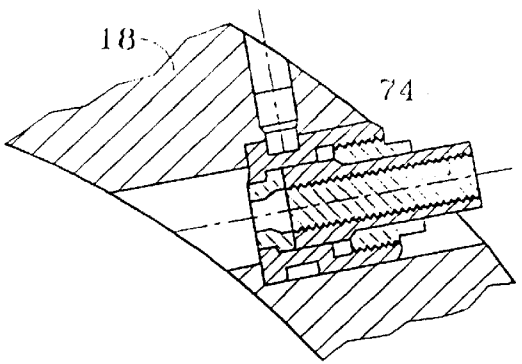
FIG. 3 is a cross sectional view of a screw bolt replacing the nozzle.

FIG. 3 illustrates the nozzle 48 removed and replaced by a screw or bolt 74.

As was mentioned previously, but is not deducible from the drawing, each of the discharge ports of nozzles 48", 48, may have a decreasing average cross-section as the axial distance from the final section 52 of the conical drum 18 is decreasing. This allows for a further separation of heavy phase 50 in stages 50', 50 and 50", which will be discharged from the bowl through lines 54.

Finally, the invention provides for non-restrictive discharge ports 56 in end section 52 of conical drum 18 so that particles from heavy phase 50 (including 50' and 50") that cannot pass through nozzles 48 (including 48' and 48") can be discharged by scroll conveyor 22, thereby precluding blockage of conical drum 18. If the internal diameter in end section 52 of conical drum 18 is small enough in relation to the cylindrical drum 16, a third intermediate phase 60 may be separated through discharge ports 56.

As was mentioned previously, nozzles 48, 48', 48" can each be screwed into threaded holes 58 in rotor wall 44. If, for example, nozzles 48' 48" are not required because of the intended application of the helix centrifuge, they can be removed and threaded holes 58 can be plugged with screw bolts (not shown).

The helix centrifuge described herein is suited to applications such as, separating a mixture 30 that is produced in drilling platforms and that consists of water, rock dust and drilling slurry, e.g. barite. The drilling slurry is reclaimed as heavy phase 50, while the mixture of water and rock dust is separated as light phase 40 and intermediate phase 60.

Figure 4:
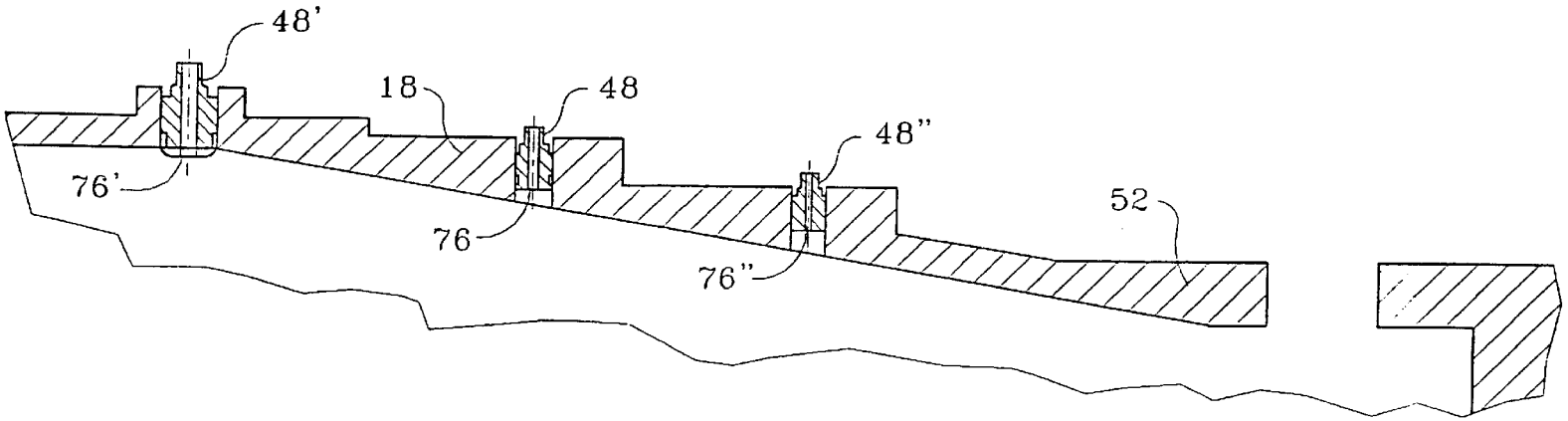
FIG. 4 is a cross-sectional view of a portion of the conical drum wherein the discharge ports in the nozzles decrease as the axial distance to the end section decreases.

As shown in FIG. 4, the size of the discharge ports in the conical drum preferably decreases as the axial distance to the end section 52 of the drum 18 decreases. Also, the size of the discharge aperture 76 in the nozzle 48 is thus smaller than the size of the discharge aperture 76' and nozzle 48', although the diameter of apertures 76 is larger than the aperture 76" in the nozzle 48".

Figure 5:
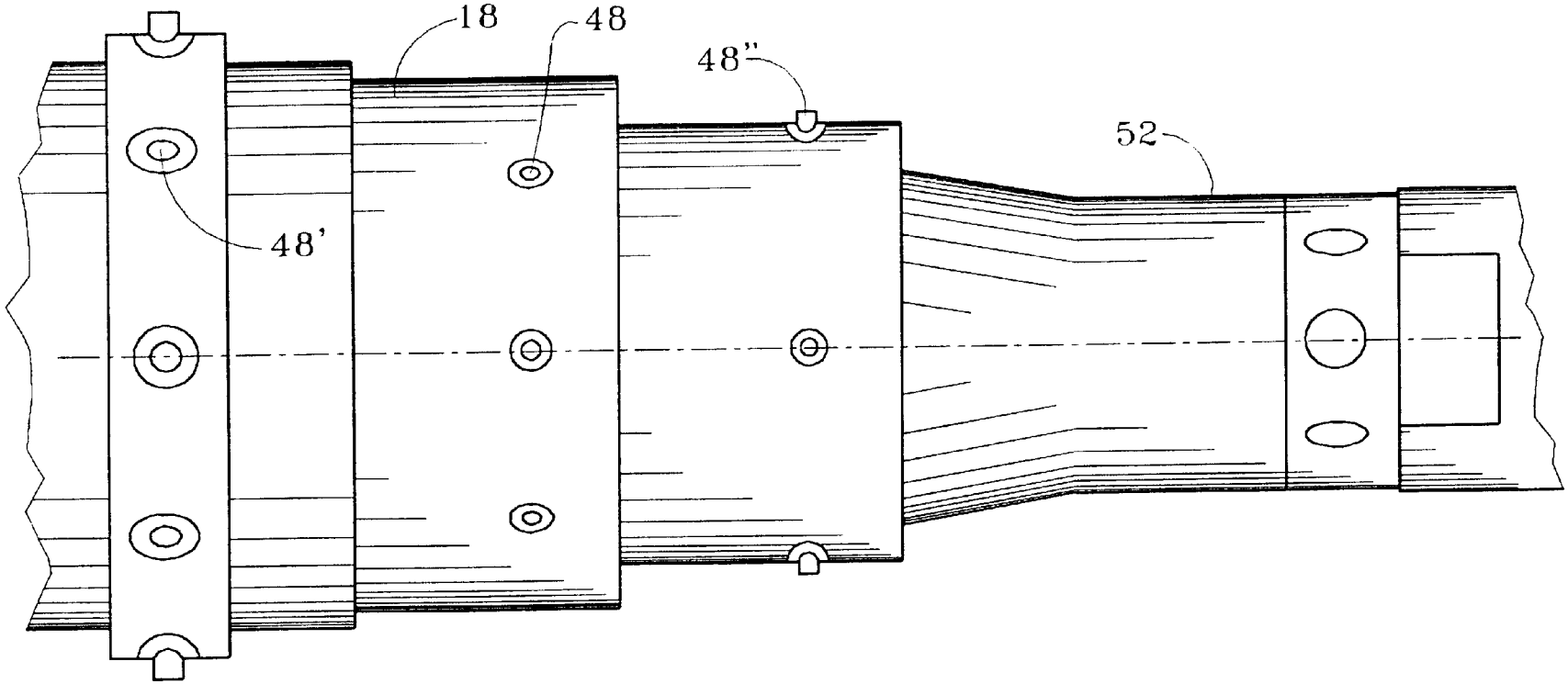
FIG. 5 is a pictorial view of a portion of the conical drum showing the nozzles arranged in axially spaced rings each within a plane perpendicular to a central axis.

As shown in FIG. 5, the plurality of nozzles may each be an arranged in axially spaced rings, which may each be within a plane perpendicular to the central axis. The plurality of nozzles 48' are shown in FIG. 5 arranged in a large diameter axially spaced ring, while the nozzles 48 are arranged in an axially spaced smaller diameter ring. The nozzles 48" are arranged in a ring closer to the end section 52, with this ring having a smaller diameter than the ring formed by the nozzles 48.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

While the invention has been described in detail for preferred embodiments, with particular emphasis upon a particular embodiment, it is to be understood that varies changes may be made through the centrifuge in the method of operating the centrifuge without departing from the spirit of the invention. Accordingly, reference of the following claims is to cover such changes and modifications that fall within the spirit and scope of the invention.

What is claimed is:

1. A helix centrifuge for continuous separation of free-flowing substances that have different densities, comprising:

a rotor rotatable about a central axis and including a cylindrical drum, a conical drum and a front end wall;

the rotor including a plurality of discharge ports in a wall of the conical drum for a heavy phase and a plurality of weirs in the front end wall of the rotor for a light phase;

a rotatable scroll conveyor within the rotor for transporting the heavy phase toward the discharge ports, the scroll conveyor including a hollow shaft and a helix;

a mixture feed pipe arranged coaxially within the hollow shaft and opening into a chamber within the hollow shaft in fluid communication with the helix;

a plurality of nozzles each removably positioned within a respective discharge port in the conical drum, each nozzle having a selectively sized discharge aperture therein for discharge of the heavy phase from the centrifuge; and a non-restrictive discharge port in an end section of the conical drum for discharge of the heavy phase from the centrifuge.

2. The helix centrifuge as defined in claim 1, wherein the plurality of nozzles are arranged in at least one circumferential ring in the rotor wall.

3. The helix centrifuge as defined in claim 2, wherein the plurality of nozzles are arranged in a plurality of axially spaced rings each located within a plane perpendicular to the central axis.

4. The solid bowl helix centrifuge as defined in claim 2, wherein the plurality of nozzles are arranged in a plurality of axially spaced rings in the conical drum.

5. The helix centrifuge as defined in claim 4, wherein the plurality of rings are axially separated by a selected spacing.

6. The helix centrifuge as defined in claim 5, wherein the nozzles are each threaded for engagement with the rotor wall.

7. The helix centrifuge as defined in claim 6, wherein threaded holes in the rotor wall are plugged with screws bolts when the nozzles are not being used.

8. The helix centrifuge as defined in claim 5, wherein said conical drum and said cylindrical drum are substantially equal in length.

9. The helix as defined in claim 4, wherein an aperture size in the plurality of nozzles reduces as the axial distance from an end section of the conical drum to the nozzles decreases.

10. A helix centrifuge for continuous separation of free-flowing substances that have different densities comprising:

a rotor rotatable about a central axis and including a cylindrical drum, a conical drum and a front end wall;

the rotor including a plurality of discharge ports in a wall of the rotor for a heavy phase and a plurality of weirs in the front end wall of the rotor for a light phase;

a rotatable scroll conveyor within the rotor for transporting the heavy phase toward the discharge ports, the scroll conveyor including a hollow shaft and a helix;

a mixture feed pipe arranged coaxially within the hollow shaft and opening into a chamber within the hollow shaft in fluid communication with the helix;

a non-restrictive discharge port in an end section of the conical drum for discharge of the heavy phase from the centrifuge;

a plurality of nozzles each removably positioned within a respective discharge port in the rotor by threaded engagement with the rotor wall; and the plurality of nozzles being arranged in at least one circumferential ring in the conical drum.

11. The helix centrifuge as defined in claim 10, wherein the plurality of nozzles are arranged in a plurality of axially spaced rings in the conical drum.

12. The helix centrifuge as defined in claim 11, wherein the plurality of rings are axially separated by a selected spacing.

13. The bowl helix as defined in claim 12, wherein an aperture size in the plurality of nozzles reduces as the axial distance from an end section of the conical drum to the nozzles decreases.

14. The helix centrifuge is defined in claim 11, wherein the aperture size in the plurality of nozzles reduces as the axial distance to an end section of the conical drum to the nozzle decreases.

15. The helix centrifuge as defined in claim 10, wherein selected ones of the plurality of discharge ports in the rotor wall are plugged with screws bolts.

16. The helix centrifuge is defined in claim 10, wherein said conical drum and said cylindrical drum are substantially equal in length.

17. A helix centrifuge for continuous separation of free-flowing substances that have different densities, comprising:

a rotor rotatable about a central axis and including a cylindrical drum, a conical drum and a front end wall;

the rotor including a plurality of discharge ports in a wall of the rotor for a heavy phase and a plurality of weirs in the front end wall of the rotor for a light phase;

a rotatable scroll conveyor within the rotor for transporting the heavy phase toward the discharge ports, the scroll conveyor including a hollow shaft and a helix;

a mixture feed pipe arranged coaxially within the hollow shaft and opening into a chamber within the hollow shaft in fluid communication with the helix;

a non-restrictive discharge port in an end section of the conical drum for discharge of the heavy phase from the centrifuge;

one or more nozzles each removably positioned within a selected discharge port in the rotor by threaded engagement with the rotor wall; and one or more threaded plugs each positioned within a selected discharge port not containing a nozzle for plugging the discharge port.

18. The helix centrifuge as defined in claim 17, wherein the discharge ports are arranged in at least one circumferential ring in the rotor wall.

19. The helix centrifuge as defined in claim 17, wherein the one or more nozzle are arranged in a plurality of axially spaced rings each located within a plane perpendicular to the central axis.

20. The helix centrifuge as defined in claim 17, wherein the discharge ports are arranged in a plurality of axially spaced rings in the conical drum.

* * * * *